US005246302A

United States Patent [19]

Wey

[11] Patent Number: 5,246,302

[45] Date of Patent: Sep. 21, 1993

[54] PAINT SUPPLYING DEVICE

[76] Inventor: Jolion Wey, P.O. Box 82-144, Taipei, Taiwan

[21] Appl. No.: 19,454

[22] Filed: Feb. 18, 1993

[51] Int. Cl.[5] ..... A46B 11/02; A46B 11/06

[52] U.S. Cl. ..... 401/153; 401/48; 401/152; 401/164; 401/172; 401/188 R

[58] Field of Search ..... 401/48, 145, 152, 153, 401/158, 161, 163, 164, 169, 171, 172, 174, 188 R

[56] References Cited

U.S. PATENT DOCUMENTS

| | | | |
|---|---|---|---|
| 1,085,789 | 2/1914 | Bennett | 401/172 X |
| 1,389,772 | 9/1921 | Miller et al. | 401/158 X |
| 3,049,745 | 8/1962 | Lambers | 401/153 |

FOREIGN PATENT DOCUMENTS

| | | | |
|---|---|---|---|
| 524935 | 12/1953 | Belgium | 401/172 |

*Primary Examiner*—Steven A. Bratlie
*Attorney, Agent, or Firm*—Alfred Lei

[57] ABSTRACT

This invention relates to a paint supplying device and in particular to one including a body portion, a compressible container disposed within the body portion and provided at the bottom with an outlet engaged with a cap, a rotating disc mounted on the top of the container and having a slot, an elevating cylinder having at the top a protuberance engaged with the slot of the rotating disc and formed with external threads, a spring arranged within the elevating cylinder, a guide ring threadedly engaged with the elevating cylinder, a movable press plate engaged with the lower end of the elevating cylinder and provided on the upper end with a neck having a flange on the top, and a brush connected with the container via a flexible pipe.

3 Claims, 5 Drawing Sheets

PAINT SUPPLYING DEVICE

BACKGROUND OF THE INVENTION

It has been found that the conventional way for a workman to apply paint is that the workman must hold a brush with one hand and a can of paint with the other and then immerse the brush into the paint and use the brush to polish on the desired object. However, such operation has the following drawbacks:

1. It is very difficult to apply paint evenly on the desired object.
2. It is inconvenient to hold the brush with one hand and a can of paint with the other.
3. The excess paint will drop down on the floor and so it is necessary to arrange waste newspaper on the floor in advance so as to prevent the floor from being dirtied.
4. A lot of paint is wasted.
5. It is time-consuming to carry out the operation of applying paint.

Therefore, it is an object of the present invention to provide an improved paint supplying device which may obviate and mitigate the above-mentioned drawbacks.

SUMMARY OF THE INVENTION

This invention relates to an improved paint supplying device.

It is the primary object of the present invention to provide a paint supplying device which may automatically and evenly supply paint to the brush.

It is another object of the present invention to provide a paint supplying device which may be operated with one hand only.

It is still another object of the present invention to provide a paint supplying device which is simple in construction.

It is still another object of the present invention to provide a paint supplying device which is paint saving in use.

It is a further object of the present invention to provide a paint supplying device which is easy to use.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
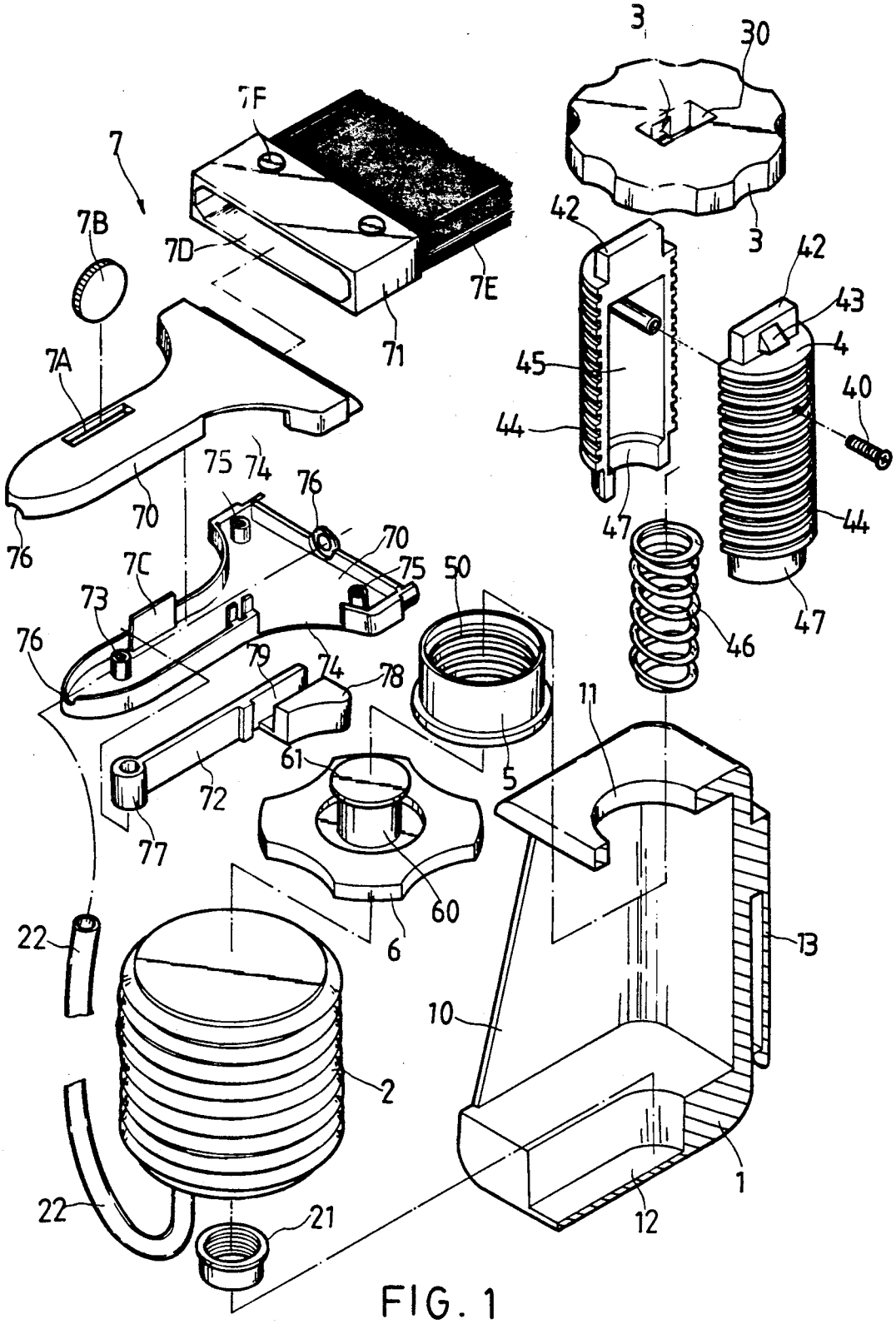
FIG. 1 is an exploded view of the present invention.
Figure 2:
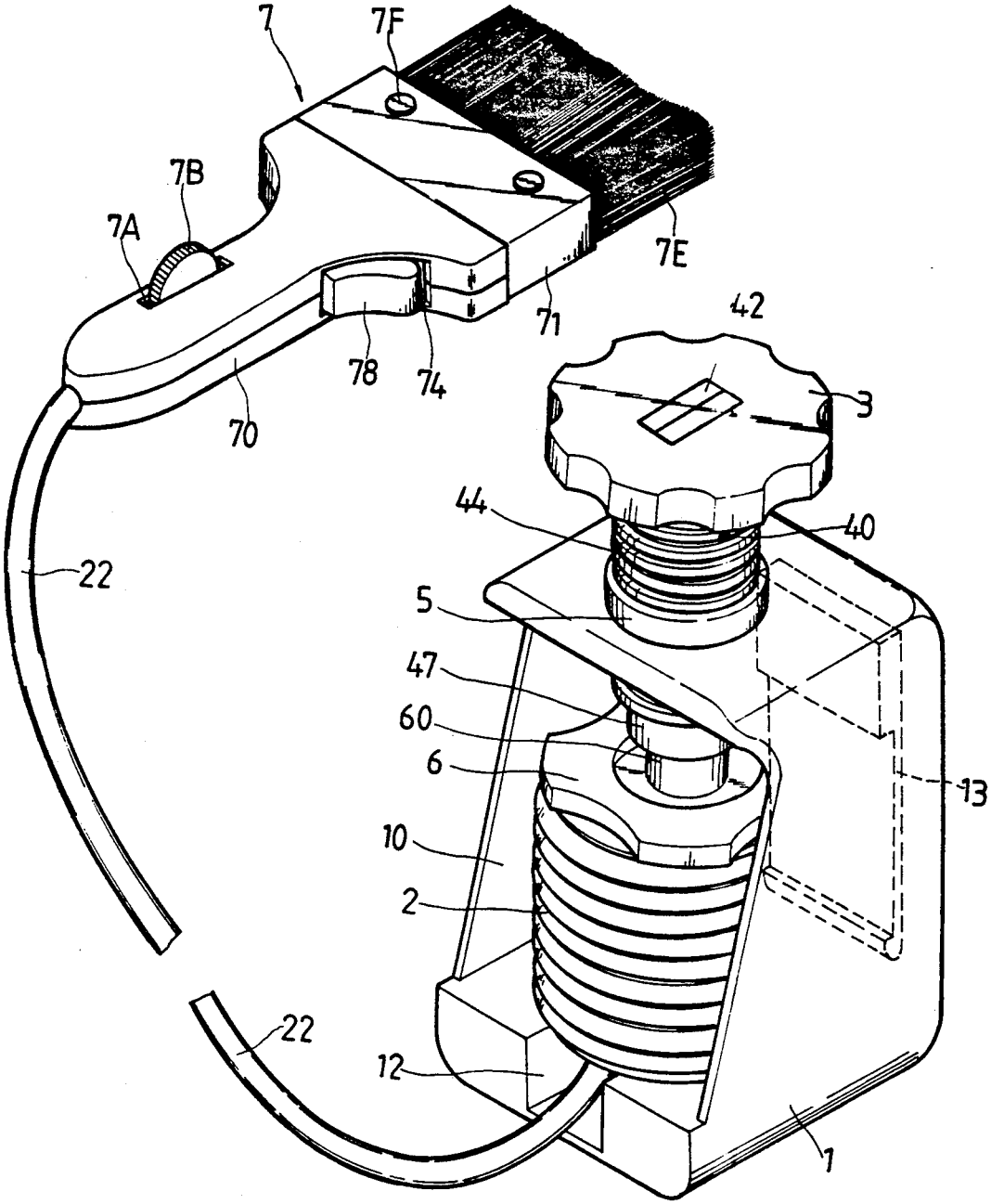
FIG. 2 is a perspective view of the present invention.
Figure 3:
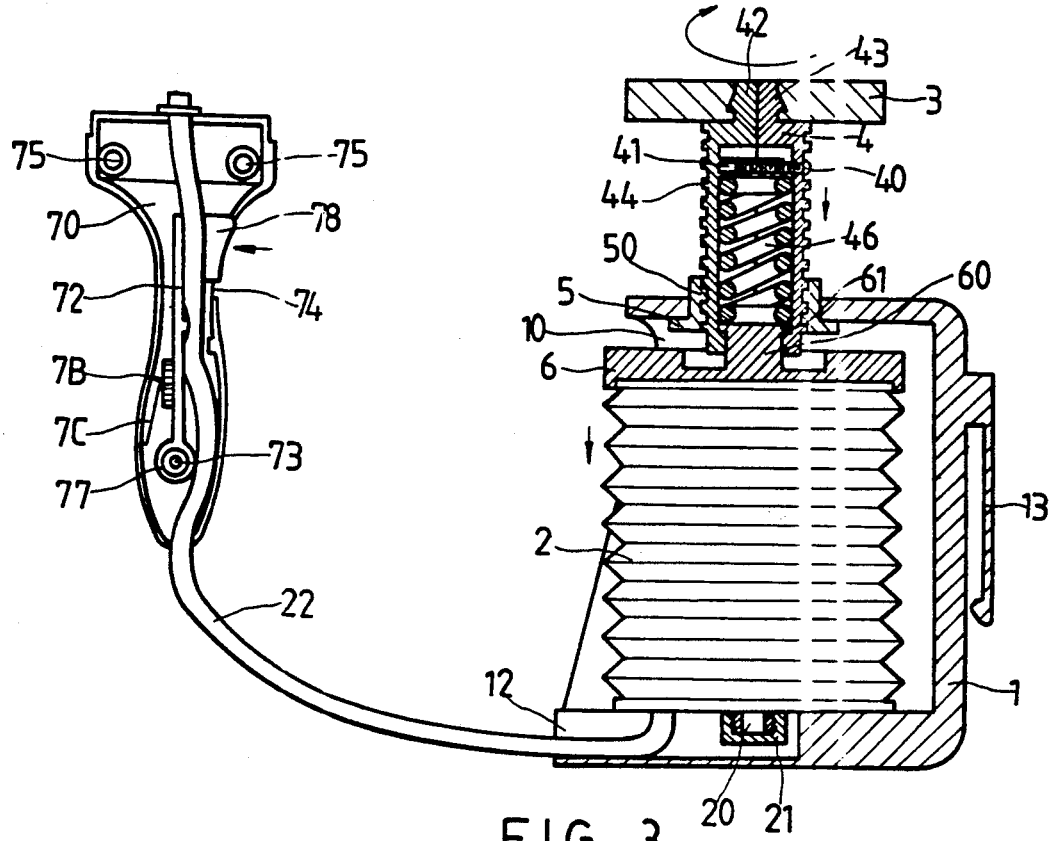
FIGS. 3, 4, 5 and 6 show the working principle of the present invention.
Figure 4:
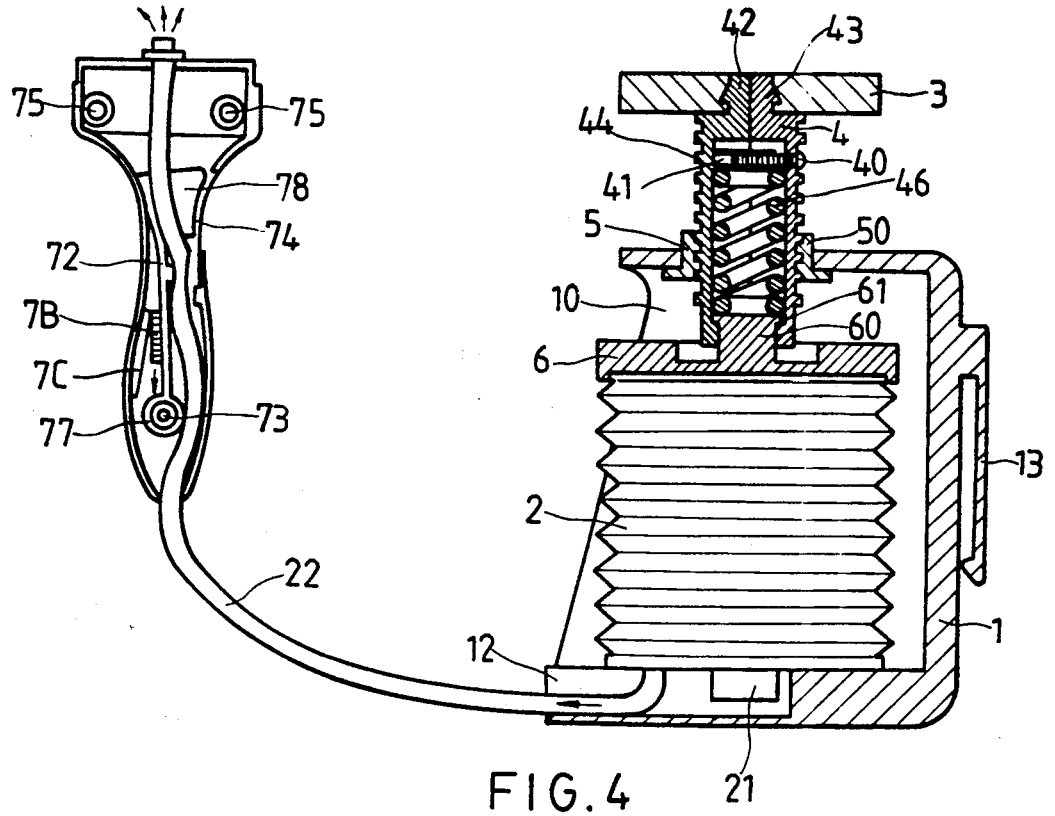
Figure 5:
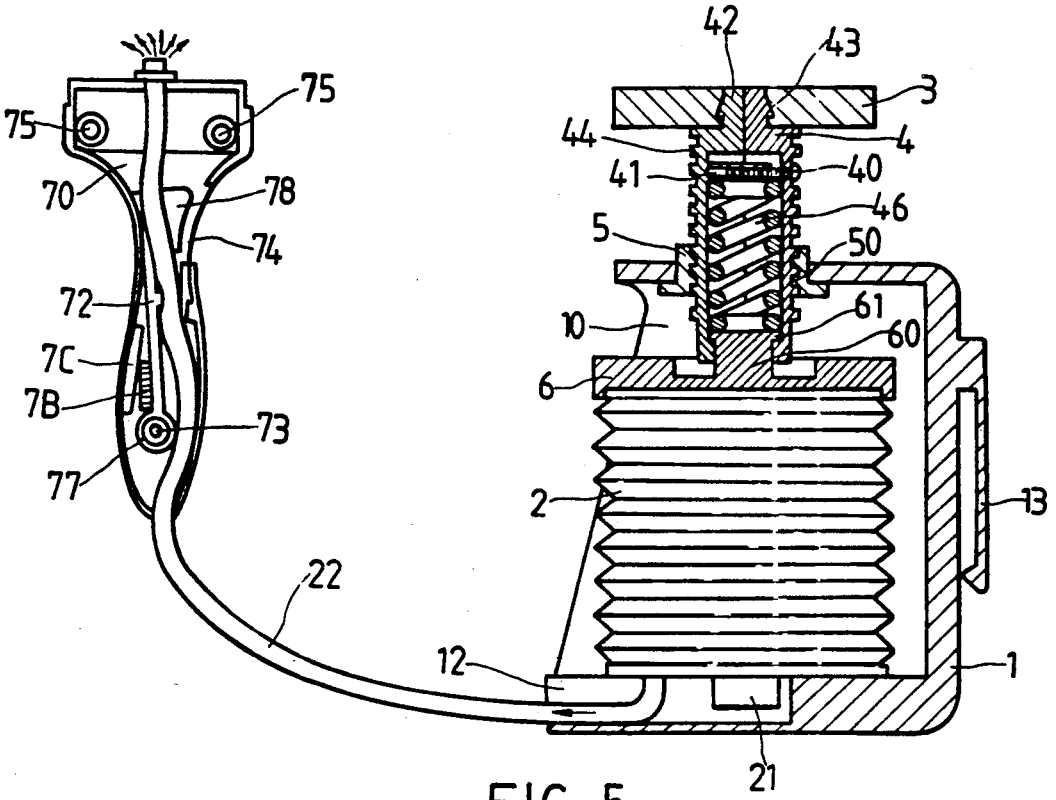
Figure 6:
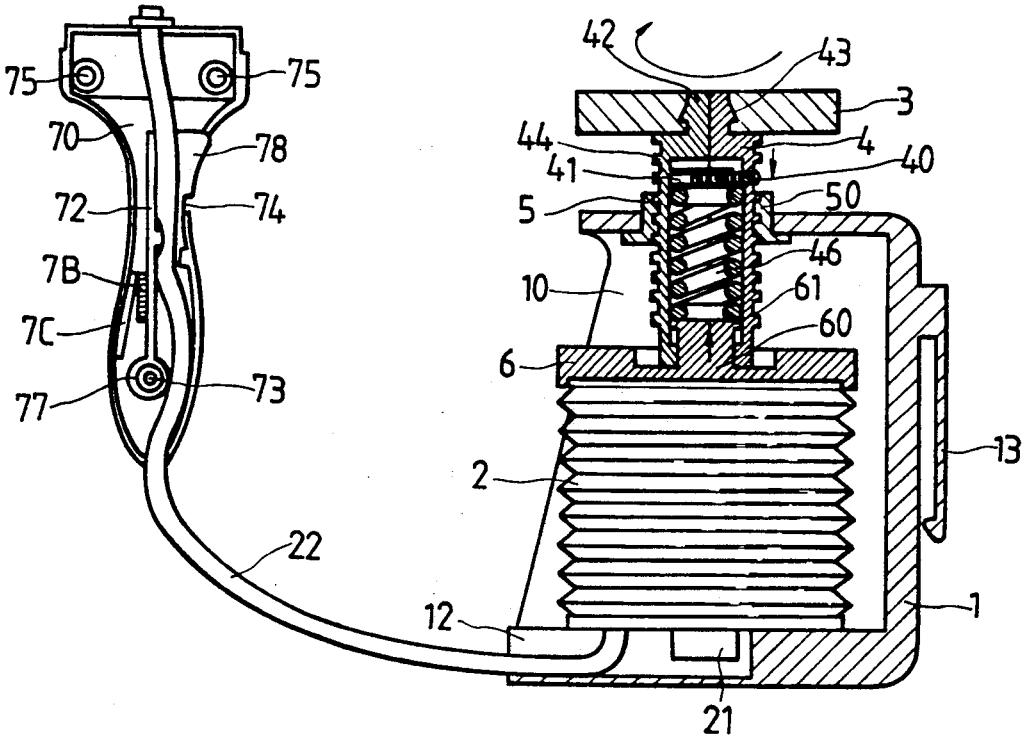
Figure 7:
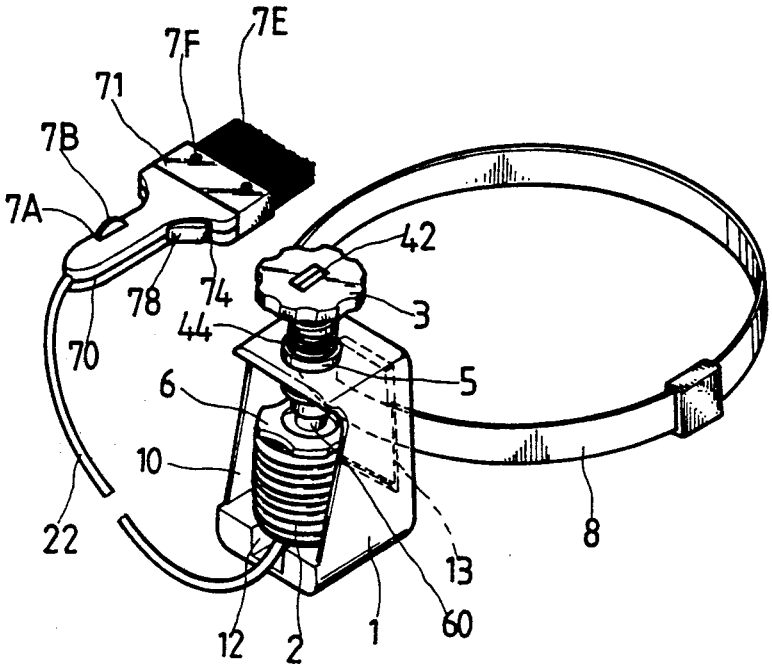
FIG. 7 shows the device attach to a users belt.

With reference to the drawings and in particular to FIGS. 1 and 2 thereof, the paint supplying device according to the present invention mainly comprises a body portion 1 having an opening 10 in which is accommodated a container 2 for receiving paint. Further, the body portion 1 is formed with a hole 11 on the top, a recess 12 on the bottom, and a hook member 13 on the rear side.

The container 2 is a compressible vessel with an outlet 20 at the center of the bottom from which paint may filled therein. In addition, the outlet 20 of the container 2 is engaged with a cap 21 for keeping the paint in the container 2. Moreover, the bottom of the container 2 is connected with a flexible pipe 22.

A rotating disc 3 is disposed on the top of the container 2, which has a slot 30 with two opposite cavities 31.

On the rotating disc 3 is mounted an elevating cylinder 4 which is composed of two halves joined together by a screw 40. The top of the elevating cylinder 4 has a protuberance 42 with a tooth 43 adapted to engage with the cavity 31 of the slot 30 of the rotating disc 3 so that the elevating cylinder 4 may be rotated in unison with the rotating disc 3. Further, the elevating cylinder 4 is formed with external threads 44 on its outer surface and has a recess 45 for receiving a spring 46. Furthermore, the elevating cylinder 4 is provided with a foot member 47.

A guide ring 50 is fitted in the hole 11 of the body portion 1 and provided with internal threads 50 engaged with the external threads 44 of the elevating cylinder 4.

A movable press plate 6 is engaged with the lower end of the elevating cylinder 4 and provided on the upper end with a neck 60 having a flange 61 on the top. The neck 60 is engaged with the foot member 47 of the elevating cylinder 4 so that the movable press plate 6 is prevented from detaching from the elevating cylinder 4.

A brush 7 is connected with the container 2 via the flexible pipe 22. The brush 7 includes a handle 70 composed of two halves, a connector 71, and a control member 72. The handle 70 includes a tubular member 73, a slot 74, two engaging members 75, and two holes 76. The tubular member 73 of the handle 70 is engaged with a collar 77 of the control member 71 while the slot 74 of the handle 70 receives a press portion 78 of the control member 72. The engaging member 75 are used to join the two halves of the handle 70 together. The holes 76 of the brush 70 are designed for the passage of the flexible pipe 22. In addition, the upper half of the brush 70 has a slot 7A for receiving an adjusting knob 7B which may be used to control the flow rate of the paint through the flexible pipe 22 in association with a blocking plate 7C. One end of the connector 71 is provided with a recess 7D for receiving the upper end of the brush 70, while the other end of the connector 71 is connected with bristles 7E by rivets 7F.

FIGS. 3 through 7 show the working principle of the present invention. As illustrated, when in use, the container 2 is first removed from the body portion 1 and filled with paint. Then, the container 2 is mounted into the opening 10 of the body portion 1 and the body portion 1 may be connected with belt 8 of an user. Thereafter, the user may regulate the position of the adjusting knob 7B so as to adjust the cross sectional area of the flexible pipe 22 thereby controlling the flow rate of the paint passing through the flexible pipe 22. Afterwards, the rotating disc 3 is turned to lower the elevating cylinder 4 so that the paint will be forced to flow to the bristles 7E of the brush 7 through the flexible pipe 2 from the container 2.

When required to supplement paint, it is only necessary to turn the rotating disc 3 to move down the elevating cylinder 4 so as to supply paint to the brush 7 through the flexible pipe 22.

As the adjusting knob 7B is set to close the flexible pipe 22, the movable press plate 6 will be kept at a fixed position even when the rotating disc 3 is turned downwards thereby protecting the container 2 from being damaged.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A paint supplying device comprising:

a body portion;

a compressible container disposed within said body portion and provided at the bottom with an outlet engaged with a cap;

a rotating disc mounted on the top of said container and having a slot;

an elevating cylinder having at the top a protuberance engaged with the slot of said rotating disc and formed with external threads;

a spring arranged within said elevating cylinder;

a guide ring threadedly engaged with said elevating cylinder;

a movable press plate engaged with the lower end of said elevating cylinder and provided on the upper end with a neck having a flange on the top; and a brush connected with said container via a flexible pipe.

2. The paint supplying device as claimed in claim 1, wherein said body portion is provided with a hook member.

3. The paint supplying device as claimed in claim 1, wherein said brush is provided with an adjusting knob adapted to control the cross-sectional area of said flexible pipe.

* * * * *